US006533266B1

(12) United States Patent
Schererz et al.

(10) Patent No.: US 6,533,266 B1
(45) Date of Patent: Mar. 18, 2003

(54) TRANSPORTATION DEVICE FOR DEFLECTING FLAT CONSIGNMENTS

(75) Inventors: Holger Schererz, Rehfelde (DE); Frank Voss, Berlin (DE); Matthias Prasser, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/700,850

(22) PCT Filed: May 3, 1999

(86) PCT No.: PCT/DE99/01325

§ 371 (c)(1),
(2), (4) Date: Nov. 17, 2000

(87) PCT Pub. No.: WO99/62805

PCT Pub. Date: Dec. 9, 1999

(30) Foreign Application Priority Data

May 29, 1998 (DE) ..... 198 24 251

(51) Int. Cl.[7] ..... B65H 5/00

(52) U.S. Cl. ..... 271/225; 271/264; 271/184; 271/198

(58) Field of Search ..... 271/225, 264, 271/184, 198

(56) References Cited

U.S. PATENT DOCUMENTS 3,932,982 A * 1/1976 Klapp ..... 271/184 X
4,850,583 A 7/1989 Monday ..... 271/240
5,103,725 A * 4/1992 Sugimoto et al. ..... 271/184 X
5,333,851 A * 8/1994 Kulpa ..... 271/225
5,899,318 A * 5/1999 Schwer et al. ..... 271/198 X
5,941,521 A * 8/1999 Enenkel et al. ..... 271/225

FOREIGN PATENT DOCUMENTS

| | | |
|---|---|---|
| DE | 326 037 | 11/1975 |
| DE | 44 37 114 C1 | 12/1995 |
| DE | 196 12 525 A1 | 10/1997 |
| EP | 0 121 245 A1 | 3/1984 |

* cited by examiner

*Primary Examiner*—David H. Bollinger
(74) *Attorney, Agent, or Firm*—Philips G. Meyers

(57) ABSTRACT

The invention pertains to a transport device for rerouting flat mail pieces (6) that are transported clamped between an endless lower band (1) and an endless upper band (2), wherein the upper band (2) is realized in a longitudinally elastic fashion and guided back in an outwardly directed loop. According to the invention, an inexpensive and space-saving rerouting with the least possible stress on the mail pieces is realized due to the fact that the driven lower band (1) is guided on a stationary, immovable guide element (3) with a sliding surface that has the shape of a curved segment, and the sliding surface of the curved segment has a lower coefficient of friction than the lower band (1) and the mail pieces (6). The lower band (1) has a low coefficient of friction on its side facing the guide element (3) and has a high coefficient of friction on its side facing the non-driven upper band (2) and the mail pieces (6). The lower band is deflected inward by means of deflection rolls (7) in such a way that it is looped around a driving roll (5) arranged within the guide element (3) with its side that has a high coefficient of friction.

13 Claims, 1 Drawing Sheet

TRANSPORTATION DEVICE FOR DEFLECTING FLAT CONSIGNMENTS

TECHNICAL FIELD OF THE INVENTION

Figure 1:
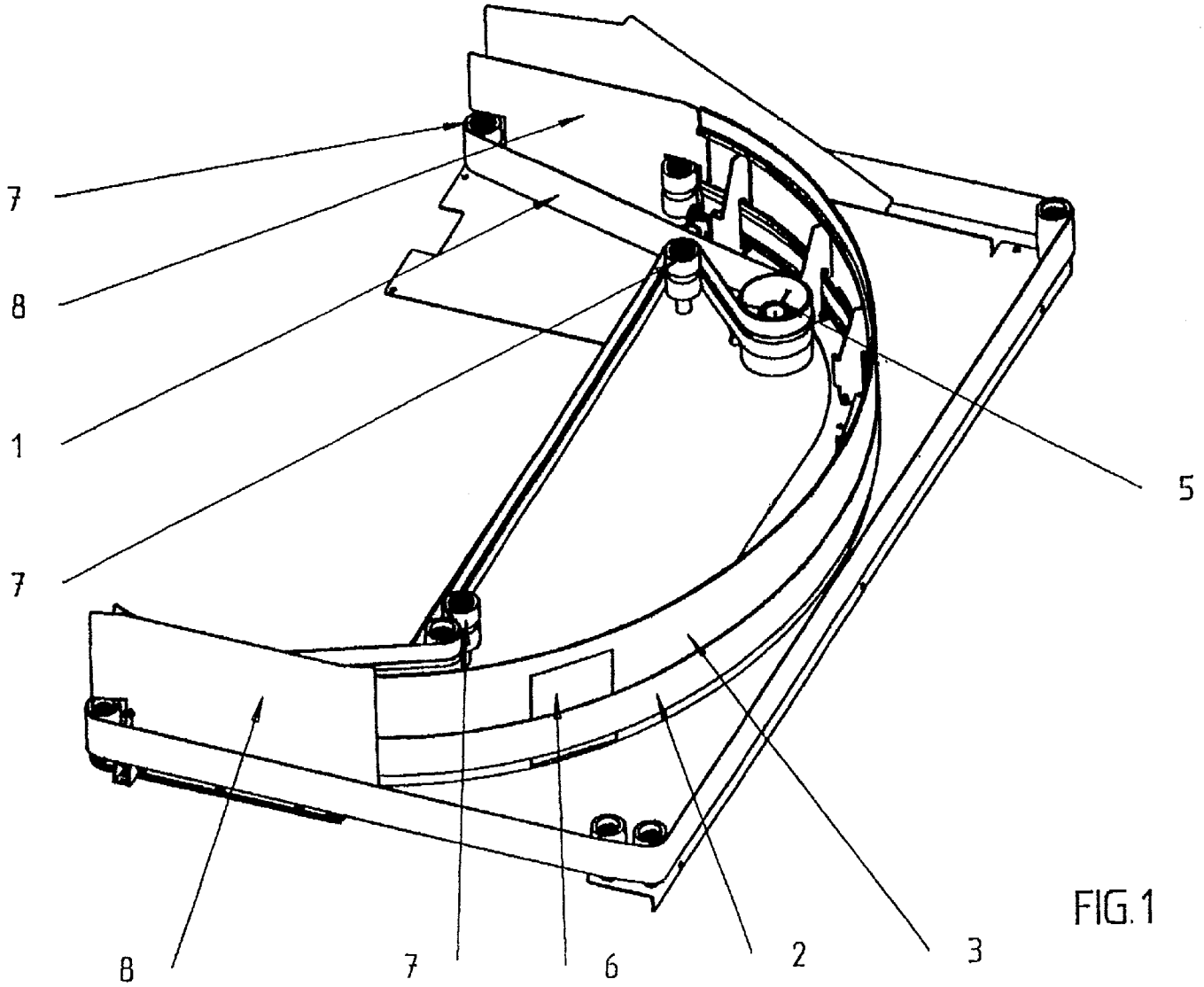

The invention pertains to a transport device for rerouting flat mail pieces according to the preamble of claim 1.

BACKGROUND OF THE INVENTION

Mail pieces are sorted in sorting stations in accordance with different criteria. These criteria, for example, can be addresses or bar codes. In such sorting machines, the flat mail pieces are transported clamped between cover bands that consist of a lower band and an upper band. In order to identify the respective sorting criteria, the mail pieces are transported in front of special cameras. The distribution information is recorded by these cameras and fed to evaluation electronics. Since a certain amount of time is required for this evaluation, the mail pieces can be sorted with the aid of guides only after this time has elapsed. This processing time is guaranteed by transporting the mail pieces, after the camera, along transport paths of greater or smaller length depending on the required evaluation time. Rerouting of the cover band paths is required along these transport paths in order to maintain a minimum space requirement.

According to DE 44 37 114 C1, the rerouting is realized with the aid of deflection rolls. The upper band is guided around a main drum. The lower band is guided past the main drum over an auxiliary drum, and the mail pieces are guided between the upper band and the main drum. If the spectrum of mail pieces necessitates large rerouting radii in order to prevent excessive bending stresses, drums with a large diameter need must be used. However, these large drums can only be manufactured with high costs and require twice the space for a 180E rerouting (only the semicircle is required).

According to DE 196 12 525, another variation for realizing rerouting consists of forming a curved path from individual rolls. The flat belts are rerouted by the curve of rolls. The disadvantage of this solution can be seen in the high cost for the large quantity of rolls required. A reduction in the number of rolls results in a polygon effect that highly stresses the mail pieces while they are transported through the curve and also leads to additional gap shifts. If the mail pieces contain carbon paper (e.g., forms, invoices), this can also result in the illegibility of the forms or invoices.

Consequently, the invention disclosed in claim 1 is based on the objective of developing an inexpensive transport device for rerouting flat mail pieces which has a small space requirement and which stresses the mail pieces as little as possible.

SUMMARY OF THE INVENTION

Through the guidance of the cover band system which consists of an endless lower band and an endless upper band over the stationary guide element with a sliding surface that is shaped in the form of a curved segment, the selection of different coefficients of friction presents a technical solution that requires a smaller depth for a large rerouting radius and consequently results in a reduced bending stress, with the manufacturing cost also being reduced.

Advantageous embodiments are defined in the subordinate claims.

At a given transport speed, the outer upper band must travel a longer distance than the lower band. In order to compensate for the resulting relative speeds without shifting or stressing the flat mail pieces, the inner side of the upper band is, according to claim 2, realized with a lower coefficient of friction.

According to claim 3, it is advantageous to realize the curved segment in the form of a segment of a circle.

In order to prevent uncontrolled runoff of the bands from the guide surface, the lower band is, according to claim 4, guided in the sliding surface of the guide element by means of a longitudinal groove.

It is also advantageous to realize the sliding surface of the guide element in an antistatic fashion according to claim 5.

According to claim 6, alignment sections are arranged at the ends of the guide element in order to compensate for inclined positions. The reception and the transfer of the mail pieces through the wider gap between the deflection rolls for the upper band and the lower band is simultaneously simplified.

The invention is described in greater detail below with reference to one embodiment that is illustrated in the FIGURE.

DETAILED DESCRIPTION

FIG. 1 shows a perspective view of a transport device for realizing 180E rerouting. A lower band 1 and an upper band 2 are guided and consequently rerouted over a stationary guide element 3 in the form of a curved segment with a smooth sliding surface that has a low coefficient of friction, in this case, a segment of a circle. The inner lower band 1 is driven by a driving roll 5 situated within the guide element 3. The lower band 1 is deflected inward by means of deflection rolls 7 in such a way that the side of the lower band 1 which faces the mail pieces 6 and which has a high coefficient of friction in order to ensure a reliable and non-slip transport of the mail pieces is looped around the driving roll 5, i.e., a largely slip-free drive is ensured. However, this also makes it necessary to maintain a certain belt tension.

The side of the lower band 1 facing the guide element 3 has a low coefficient of friction such that the lower band 1 slides easily over the guide element 3 without wear. However, the lower band 1 must be guided such that it cannot run off the guide element 3 toward the top or the bottom. This is the reason why a longitudinal groove is arranged in the sliding surface of the guide element 3, and the lower band 1 is provided with a longitudinal element 8 in the form of a strip that is guided in the longitudinal groove on its side facing the guide element 3. The upper band 2 which is guided around the guide element 3 on the lower band 1 is also driven by the lower band. The mail pieces 6 are clamped between the two bands. Since the mail pieces 6 have different thicknesses and a clamping of the mail pieces between the two bands must be ensured, the upper band 2 is realized in a longitudinally elastic fashion such that it is able to adapt to different contours and a clamping effect is also ensured for mail pieces of alternating thicknesses.

The following aspects must be observed during the geometric design of the sliding surface of the guide element 3, e.g., during the selection of the rerouting radius:

Particularly thick and/or stiff mail pieces cannot completely rest against the sliding surface 3 if the radius is chosen excessively small, and this leads to an additional separation of the elastic upper band 2 and the lower band 1. If very thin and very thick, stiff mail pieces 6 are alternately transported with minimal gaps, the thin mail pieces 6 may become no longer reliably clamped between the two bands if the radius is chosen too small. This would result in impermissible gap shifts.

The sliding surface of the guide element 3 has the following properties:

1. A low coefficient of friction in comparison to the lower band 1 and the mail pieces 6;
2. An optimally smooth surface for ensuring a sliding process without wear and little noise, and
3. Resistant to wear and preferably antistatic.

Since the upper band 2 must travel a longer distance than the lower band 1 at a given speed (the neutral fiber travels on the larger radius), the inner side of the upper band 2 has a lower coefficient of friction. This makes it possible to compensate for inevitably occurring relative speeds without stressing or shifting the mail pieces 6.

The guide element 3 is not realized in the form of a complete semicircle, but rather in the form of a segment of a circle. Alignment sections 8 are arranged in front and behind the ends of the guide element 3. These alignment sections respectively consist of two upright guide plates and an underfloor band. The deflection rolls for the upper band and the lower band are located at the inlet and the outlet of the alignment sections 8, wherein said deflection rolls are arranged at such a distance from one another that the mail pieces are not clamped between the upper band and the lower band, i.e., the mail pieces are aligned and transported by this underfloor band within these regions.

What is claimed is:

1. Transport device for rerouting flat mail pieces (6) that are transported clamped between an endless lower band (1) and an elastic endless upper band (2), characterized by the fact that the lower band (1) is guided on a stationary, immovable guide element (3) with a sliding surface that has the shape of a curved element, wherein the sliding surface of the curved segment has a lower coeficient of friction than the lower band (1) and the mail pieces (6), the lower band (1) has a lower coefficient of friction on a side facing the guide element (3) than on a side facing the non-driven upper band (2) and the mail pieces (6), and the lower band (1) is deflected inward by means of deflection rolls (7) such that the lower band is partially looped around a driving roll (5) arranged within the guide element (3).

2. Transport device according to claim 1, characterized by the fact that the upper band (2) has a lower coefficient of friction on its inner side than on its outer side.

3. Transport device according to claim 1, characterized by the fact that the guide element (3) is realized in the form of a segment of a circle.

4. Transport device according to claim 1 characterized by the fact that the guide element (3) contains a longitudinal groove on it sliding surface, and the lower band (1) contains a strip-shaped longitudinal element (8) that is guided in the longitudinal groove of the guide element on its side facing the guide element (3).

5. Transport device according to claim 1 further comprising an alignment section (8) arranged in front of the inlet of the guide element (3), and an alignment section (8) arranged behind the outlet of the guide element (3), wherein said alignment sections each comprise two lateral guides and an underfloor band, and deflection rolls (7) for deflecting the upper band and the lower band (2,1) spaced respectively apart at the inlet and the outlet of the alignment sections (8) such that the mail pieces (6) are transported and aligned by the underfloor band within these regions.

6. A transport device for rerouting flat mail pieces, comprising:

an endless lower band, the lower band having a first side and a second side, the second side having a higher coefficient of friction than the first side;

a drive roller for driving the lower band;

a guide element including a curved surface for guiding the lower band;

a non-driven elastic endless upper band, the upper band clamping mail pieces against the lower band for transport along the guide; and the first side of the lower band facing the guide element and the second side of the lower band contacting the non-driven upper band.

7. The transport device of claim 6, further comprising deflection rolls, the deflection rolls deflecting the lower band,inward to loop around the drive roller and wherein the drive roller is positioned within the curved portion of the guide and the second side of the lower band contacts the drive roller.

8. The transport device of claim 6, wherein the guide element further comprises a longitudinal groove on its sliding surface and wherein the lower band further comprises a strip-shaped longitudinal element guided in the longitudinal groove of the guide element.

9. The transport device of claim 6, wherein the curved surface of the guide element is formed from an antistatic material.

10. The transport device of claim 6, further comprising a first alignment section arranged in front of the guide element and a second alignment section arranged behind the guide element, each of the alignment sections comprising two lateral guides and an underfloor band, the first and second alignment sections being spaced from the guide element so that the mail pieces are transported and aligned by the underfloor band within the alignment sections.

11. A transport device for rerouting flat mail pieces, comprising:

an endless lower band, the lower band having a first side and a second side, the second side having a higher coefficient of friction than the first side;

a drive roller for driving the lower band;

a guide element including a curved surface for guiding the lower band;

a non-driven elastic endless upper band, the upper band clamping mail pieces against the lower band for transport along the guide; and the first side of the lower band facing the guide element and the second side of the lower band contacting the non-driven upper band;

a first and second alignment sections positioned at each end of the guide element for aligning mail pieces entering and exiting the transport; and an underfloor band associated with each of the first and second alignment sections, the under floor band transporting mail pieces within the alignment sections.

12. The transport device of claim 11, wherein the guide element further comprises a curved surface including a longitudinal groove and wherein the lower band further comprises a strip-shaped longitudinal element guided in the longitudinal groove of the guide element.

13. The transport device of claim 11, further comprising deflection rolls, the deflection rolls deflecting the lower band to loop around the drive roller.

* * * * *